US008663360B2

(12) United States Patent
Zhou et al.

(10) Patent No.: US 8,663,360 B2
(45) Date of Patent: Mar. 4, 2014

(54) FLOATING ENTRAINMENT METALLURGICAL PROCESS AND REACTOR

(75) Inventors: Songlin Zhou, Liaocheng (CN); Weidong Liu, Liaocheng (CN)

(73) Assignee: Yanggu Xiangguang Copper Co., Ltd., Liaocheng, Shan Dong Province (CN)

( * ) Notice: Subject to any disclaimer, the term of this patent is extended or adjusted under 35 U.S.C. 154(b) by 0 days.

(21) Appl. No.: 13/696,728

(22) PCT Filed: Aug. 9, 2011

(86) PCT No.: PCT/CN2011/001304

§ 371 (c)(1),
(2), (4) Date: Nov. 29, 2012

(87) PCT Pub. No.: WO2013/013350

PCT Pub. Date: Jan. 31, 2013

(65) Prior Publication Data

US 2013/0069287 A1 Mar. 21, 2013

(30) Foreign Application Priority Data

Jul. 25, 2011 (CN) ..... 2011 1 0208013

(51) Int. Cl.
*F27B 17/00* (2006.01)

(52) U.S. Cl.
USPC ..... 75/455; 75/639; 266/182

(58) Field of Classification Search
USPC ..... 266/182; 75/707, 455, 639
See application file for complete search history.

(56) References Cited

U.S. PATENT DOCUMENTS

| | | | | |
|---|---|---|---|---|
| 4,331,087 | A | 5/1982 | Kunttu et al. | |
| 4,334,919 | A * | 6/1982 | Queneau et al. | 75/414 |
| 4,392,885 | A | 7/1983 | Lilja et al. | |
| 5,133,801 | A | 7/1992 | Saarinen | |
| 5,362,032 | A | 11/1994 | Ranki | |
| 5,370,369 | A | 12/1994 | Lilja et al. | |
| 5,443,620 | A * | 8/1995 | Kaasinen et al. | 75/629 |

FOREIGN PATENT DOCUMENTS

| | | |
|---|---|---|
| CN | 1041647 A | 4/1990 |
| CN | 1113213 C | 7/2003 |
| CN | 1528926 A | 9/2004 |
| CN | 1243839 C | 3/2006 |
| CN | 101705369 B | 1/2011 |
| FI | 932458 | 11/1994 |
| GB | 1 569 813 | 6/1980 |
| JP | A-06-225495 | 8/1994 |

OTHER PUBLICATIONS

May 3, 2012 International Search Report issued in International Patent Application No. PCT/CN2011/001304 (with partial translation).

May 3, 2012 Written Opinion of the International Searching Authority issued in International Patent Application No. PCT/CN2011/001304 (with partial translation).

* cited by examiner

*Primary Examiner* — Scott Kastler
(74) *Attorney, Agent, or Firm* — Oliff PLC

(57) ABSTRACT

A floating entrainment metallurgical process includes injecting a reaction gas and powdery materials into a reaction furnace, aiming to obtain a controllable highly rotating and floating state and reach the ignition point under the high-temperature radiation of the reaction furnace to combust intensely. Meanwhile, a rotating fluid injected in the reaction furnace will drive the furnace gas, and forms a relatively low-temperature circular backflow protection area around the rotating fluid.

8 Claims, 2 Drawing Sheets

FLOATING ENTRAINMENT METALLURGICAL PROCESS AND REACTOR

BACKGROUND

The invention relates to a nonferrous metallurgical process and reactor, and more specifically, to a floating entrainment metallurgical process and reactor.

In the nonferrous metal industry, pyrometallurgy refers to a process of obtaining nonferrous metals by removing the sulfur and iron in the sulfide ore by reacting the ore with oxygen. With the development of the metallurgical industry, progress of technology, as well as higher requirements for environmental protection, how to strengthen the smelting process and reduce production cost has become an important subject in the metallurgical industry, thus promoting new metallurgical processes to emerge continuously. Though following the same chemical reaction mechanism, pyrometallurgy can be roughly divided into two general types of processes: bath smelting and spatial suspension smelting, of which spatial suspension smelting is most widely applied in the Outokumpu Flash Smelting invented by Finnish scientists in 1949. In essence, spatial suspension smelting is intended to fully combine the material particles with the oxygen on the huge surface area of powder sulfide deposit after drying to realize instant oxidation (within 2 or 3 s), thus achieving desulfurization. During oxidation, an enormous amount of heat is generated, and the products, i.e. flue gas and melt, are at a high temperature, which means that the reaction furnace needs to bear an enormous heat load. Currently, a widely recognized suspension smelting furnace can stand a thermal load of up to 2000 $MJ/m^3 \cdot h$, but higher thermal loads will severely erode and corrode the furnace lining.

Spatial suspension smelting is a continuous production process, in which the material and oxygen are continuously added in proportion with the calculated results for metallurgy. It is required that the materials and corresponding oxygen are fully combined and reacted in the metallurgical furnace within a limited space and time, otherwise, raw materials might flow out and peroxidation might occur. According to the already known methods described in CN1232538A (International publication No.: WO98/14741, Apr. 9, 1998), GB1569813, U.S. Pat. No. 5,133,801, U.S. Pat. No. 4,392,885, U.S. Pat. No. 5,362,032, U.S. Pat. No. 5,370,369, FI932458 and JP5-9613, the reaction gas is fed into the reaction furnace vertically from the lateral of the material flow, and the vertically dropped material is imported into the reaction gas by the distributor set on the center of the material flow and the diffused air in the horizontal direction, thus obtaining a suspended state. In these methods, the materials and reaction gas are kept away from the central axis and run towards the furnace wall until filling the entire space of the reaction furnace. What's to mention is that the furnace lining of the reactor will be greatly eroded and corroded by the high temperature during reaction and high-temperature melts directly, which requires the lining to favorable perform under enormous thermal load. Additionally, granularity and proportion of the materials are not completely equivalent, which makes it impossible to obtain an even distribution of the materials in the reaction gas. Areas with fewer materials might be exposed to excessive oxygen and the materials will be peroxided; while areas with more materials might lack enough oxygen and the materials shall be under the level of oxidation, resulting in raw materials that will not be oxidized.

In order to solve the above deficiencies, China patent (03125473) describes a spatial smelting method using a central rotating column: the dried powder material and oxygen are tangentially fed in through the burner set on the top center of the reaction shaft. Consisting of a number of concentric circular vortex chambers, an air chamber forms along the outside part of the concentrate chute; the inside part of the concentrate chute is equipped with an umbelliform dispersing cone, which is horizontally set with injection holes. In this process, the reaction gas remains at the outer surface of the material, therefore, it's necessary to use the gas jetted from the dispersing cone in the center of the material and the injection holes to mix the material and the reaction gas; the reaction gas passes through the vortex chamber into the high-temperature reaction shaft, and is expanded in volume by heating. Smaller amounts of jetted gas may result in the materials and the reaction gas failing to mix, while larger amounts of gas may destroy the vortex, thus making the materials and the reaction gas spread to the wall of the reaction shaft along the tangent direction. Moreover, injection holes are easily blocked and lose their function once in contact with the materials, and the cyclic non-contact transition collar will lower the utilization rate of oxygen, wherein the oxygen enters into the process equipment after the reaction furnace together with the furnace gas, and reacts with $SO_2$, which generates sulfuric acid during cooling that further corrodes the equipment.

Similarly, China patent (Patent No.: ZL200910230500.3) describes that the dried materials and oxygen-enriched air are fed into a burner respectively, and are mixed to form a gas-solid two-phase mixture, which is rotated into the reactor at a high speed by a cyclone mounted in the burner, to form a rotary fluid with the axis as the center. In order to improve the probability of collisions between particles and to increase the amount of oxygen in the center of the rotary fluid, a pulser is further provided in the center of the nozzle to feed the oxygen or oxygen-enriched air into the rotary fluid by pulses.

Gas-solid two-phase mixture can also be available by this process, but a high rotating speed might be required to maintain the mixture in the reaction furnace. Gas-solid two-phase mixture at high rotating speed might cause serious abrasion to the burner and cyclone, which might result in failure of the burner in a short period. The pulsating oxygen or oxygen-enriched air is fed into the center of the rotary fluid and it is judged from the section of the rotating fluid whether the vortex core actually is a cavity with no materials or a few materials. Moreover, the pulsating feeding of oxygen or oxygen-enriched air makes the center materials fall too fast and down to the bottom without reaction. In addition, the change of the center oxygen potential causes a change in the reaction time and space, and increases the collision probability among particles, while simultaneously causing a fluctuation of the flue gas, or even results in resonance of the exhaust equipment, such as a waste heat boiler. The materials can form a gas-solid two-phase mixture before entering the reaction furnace, and consequently, the material particles can only be heated by high temperature radiation in the furnace and it take too long to reach the ignition point.

SUMMARY

This invention aims to overcome the defects of the prior art and provides a floating entrainment metallurgical process and reactor. This invention introduces a process to make the reaction gas transfer into a gas flow by using the self-contained energy after the operation mode is changed, and enter into the reaction furnace to entrain the dry powdery material and the furnace gas, thus achieving the processes rapidly, i.e. heat and ignite the material particles to conduct the oxidation reaction and then re-mix the products. With this invention, the material specific surface area and reacted heat energy can be fully used, and the heat load which the reaction furnace can withstand can be effectively improved to avoid erosion and corrosion of the metallurgical furnace wall during a high-temperature melting process. In addition, the oxygen utilization rate can be effectively improved with reduced amounts of smoke gas and $NO_x$ emissions, which will better meet the requirements for strengthening metallurgy with high productivity and low energy consumption.

The following technical scheme is adopted in this invention to achieve the above purpose:

The floating entrainment metallurgical process includes gas supply, material supply, and airflow reaction:

Gas supply: the reaction gas is tangentially fed into the rotating gas generator along a plurality of uniformly distributed rotary air inlets, which are adjustable by a control valve to provide controllable rotating airflow, and a conical exit air speed controller that can be moved up and down is provided to control the exit area of the rotating gas generator, thus controlling the velocity of the reaction gas into the reaction furnace;

Material supply: powdery material flows through a circular space, enters the reaction furnace, and is then involved in the high-speed rotating airflow; and Airflow reaction: the furnace gas, which is spurred and entrained by rotating fluid which is jetted into the reaction furnace from the top to the bottom, forms a gas-solid mixed rotating fluid together with the powdery material and the reaction gas, wherein the powdery material is highly dispersed in the reaction gas, which rotates at high speed in a radial direction moving downward in the axial direction.

Meanwhile, the furnace gas flows back from the bottom to the top of the reaction furnace, and the injection and rotation of the rotating fluid within the reactor furnace forms the furnace gas into a circular backflow protection area, such that the molten droplets accompanied by the backflow furnace gas form into a refractory substance protection layer on the lining of the reaction furnace.

The reaction gas is oxygen-enriched air, whose oxygen concentration is 21% to 99% in volume ratio.

The gas-solid two-phase mixed rotating fluid rotates at a high speed around the central axis of the reaction furnace, and the material particles are quickly heated to the ignition point by the backflow furnace gas and the radiant heat in the furnace.

The floating entrainment metallurgical reactor is equipped with a rotating gas generator in the center, the top of which is blocked by a blocking board, and a plurality of evenly distributed rotary air inlets are set on the upper section of the rotating gas generator vertical to the central axis. In order to provide a certain initial velocity of the reaction gas when fed into the rotating gas generator, a control valve is installed at the rotary air inlet. The central axis of the rotating gas generator is provided with a center axle sleeved with a conical outlet wind velocity controller which can allow up-and-down movement in the cavity of the rotating gas generator. The cavity refers to the reaction gas channel, and a reactor outer shell is equipped on the outside, and the outer shell shares the same central axis with the rotating gas generator. There is a circular space between the outer shell and the generator as a channel for the materials to flow. Flow distributing devices are set on the material inlet of the rotating gas generator with each flow distributing device being connected with a corresponding dosing feeder.

The exit at the lower end of the rotating gas generator is in the shape of a cone.

The upper end of the center axle is fixed on the blocking board at the top of the rotating gas generator.

The outer shell is equipped with water-cooling elements.

On the blocking board is set with a lifting device for an outlet wind velocity controller.

In this invention, the rotating gas generator, rotary air inlet, control valve, outlet velocity controller, flow distributing device, dosing feeder and water-cooling elements are known in the prior art and it is unnecessary to provide further details here.

In this invention, the reaction gas and the powdery solid materials are fully combined to form a rotary fluid, aiming to obtain a controllable highly dispersed rotating and floating state when injecting the reaction gas and the powdery materials into the reaction furnace. Meanwhile, the rotating fluid injected in the reaction furnace drives the furnace gas, and forms a relatively low-temperature backflow protection area around the rotating fluid, which reaches the ignition point upon radiation by the high temperature of the reaction furnace to burn fiercely.

The reaction furnace in this invention is a cylindrical structure installed vertically to the horizontal plane, and the reaction gas and the powdery materials are fed in vertically downwards at the top. In order to finish the heat and ignition processes, oxidation reaction to remix of the products for the powdery materials in the reaction furnace from top to bottom, and prove that the oxygen can be completely consumed, all material particles shall be able to be involved in the reaction and transferred to be molten. At the same time, high-temperature consumption of the reaction furnace lining can be avoided. In this invention, the reaction gas is converted into a rotary air flow and jetted into the reaction furnace, entraining the materials that fall freely through the circular space and the high-temperature furnace gas (relative to the reaction gas) at the top of the reaction furnace to form a gas-solid two-phase mixed rotating fluid rotating at a high speed in the radial direction that moves downwards along the center axle of the reaction furnace. In the rotating fluid, the material particles and the reaction gas are heated to the ignition point by high-temperature furnace gas (relative to the reaction gas), and react chemically. The material particles are fused into small droplets, collide with each other, grow, and separate from the reacted gas by the high temperature generated from the reaction. As the power source, the reaction gas significantly contributes to the radial rotational velocity and the axial injection velocity. The material particles and oxygen are fully combined, rapidly heated to the ignition point, and combust. The high-temperature area generated from the reaction is centralized to a large extent. Generally, the smaller the radiation scope of the furnace lining, the greater the probability for the fused products to collide, combine, and grow, which means that the rotating velocity of the gas-solid two-phase mixed rotating fluid and the injection velocity to the reaction furnace can be controlled and regulated.

According to the method in this invention, the gas-solid two-phase mixed rotating fluid is formed by reaction gas, material particles, and high-temperature furnace gas in the reaction furnace. The reaction gas can rotate at a high speed in the cavity of the rotating gas generator without any wear because the reaction gas doesn't carry solid particles. The powdery material falls freely in an circular channel between the outer shell and the rotating gas generator, and the wear to the outer shell and generator is negligible because the falling speed is low. Therefore, the device (generator) can allow long-term continuous operation without breakdown. As is well known, the material particles can only react with oxygen instantly when heated to the ignition point, and in fact, the time for heating determines the reaction time. According to the method presented in this invention, the powdery materials fall freely around the reaction gas, and the rotating reaction gas entrains the powdery materials and high-temperature furnace gas in the reaction furnace to form a gas-solid two-phase mixed rotating fluid, which indicates that the high-temperature furnace gas is entrained through an circular material flow, to provide instant heat to the material particles and rapidly heat the particles to the ignition temperature as soon as fed into the reaction furnace, thus to make the material particles heated and reacted chemically very quickly.

The reactor is installed vertically to the top of the cylindrical furnace, forming a flow pipe structure with a sudden expansion. According to the method presented in this invention, the reaction gas is the only power source. In order to obtain the controllable rotary flow, the reaction gas is adjusted to a certain initial velocity by the control valve before entering the rotating gas generator; the reaction gas has a certain centripetal force on the outlet of the generator and the outlet velocity of the reaction gas can be adjusted optionally within the circular space. When injecting the entrained materials and furnace gas into the reaction furnace, all the material moves to the central axis at the same time. In fact, the center of the formed mixed rotating fluid is an area with an oxygen potential and materials that are intensely concentrated, that is, the section of the mixed rotating fluid is an enrichment area with all material centering the vortex core, and the material distribution density of the mixed rotating fluid decreases gradually from the inside to the outside.

As the mixed rotating fluid moves from the top towards the bottom, it reaches the ignition temperature and reacts, and the instant high temperature generated from the reaction rapidly expands the volume of the rotating fluid and weakens the rotating state of the rotating fluid. Owing that the vortex core enriches all substances (that is, this area is the focal area and high-temperature region), the temperature of the mixed rotating fluid after reaction will decrease gradually centering the cortex core.

The rotating fluid after reaction is composed of molten droplets and furnace gas, and the molten droplets collide, grow, settle, and separate from the furnace gas. The furnace gas with a relatively lowered outermost surface temperature of the rotating fluid whose rotation state has been weakened moves from the bottom towards the top, filling the top space of the reaction furnace, and forms a circular backflow protection area between the rotating fluid and the reaction furnace wall. Additionally, some small molten droplets are carried with the backflow furnace gas and fall on the internal lining of the reaction furnace and the refractory substances (e.g. magnet) left and forms a protection layer.

According to the method presented in this invention, the reaction gas is the only power source and proof of combination and reaction between materials and oxygen. In order to maintain the state of the mixed rotating fluid in the reaction furnace and form the oxygen potential and material enrichment zone on the axle, the oxygen concentration should be from 21 vol % to 99 vol %, and the heating time in the reaction furnace should be short enough with enough residence time. The rotating speed, centripetal acceleration, and downward injection velocity of the reaction gas when entering into the furnace are the most important key parameters.

With respect to the steplessly adjustable reactor in this invention, the top of the rotating gas generator is blocked by a blocking board and divided into three parts: the air inlet is arranged with a plurality of rotary air inlets, the middle part forms to be a cylinder, and the exit is conical with gradual shrinkage to obtain a greater centripetal acceleration after the reaction gas is jetted out. The rotary air inlets are vertical to the central axis and distributed at equal angles to prove a minimum bias current of the rotating flow at the outlet of the generator. All control valves are controlled by the same signal with simultaneous operation at the same opening, only to control the inlet speed without change to the inlet direction.

The outlet of the generator is designed to be conical with gradual shrinkage to give the rotary airflow a centripetal acceleration.

In order to ensure the material outflow from the generator is uniform and matches with the reaction gas, a plurality of flow distributing devices are set on the material inlet of the generator with each device connected to a dosing feeder.

The reaction gas rotates at a high speed centering the center axis after being fed into the rotating gas generator, and moves to the outlet under action of the blocking board at the top of the generator, and the axial velocity and the radial velocity are maximized at the outlet.

The circular space between the outer shell and the rotating gas generator is the material channel with the exit designed to be conical with gradual shrinkage to facilitate entrainment of the material flow by the reaction gas.

A center axle is set on the axle line of the rotating gas generator with the blocking board on the top as support, and the outer wall of the rotating gas generator is installed with a conical wind velocity controller that can be moved up and down at a certain height in the cavity of the rotating gas generator to control the circular outlet area, so as to gradually reduce the airflow area along the exit of the reaction gas, thus controlling the reaction gas to be injected into the reaction furnace.

In order to avoid deformation of the circular material channel, the outer shell is equipped with water-cooling elements to help the outer shell withstand high temperature.

In order to ensure that the material flow can be entrained accurately and evenly by the reaction gas, a plurality of flow distributing devices and corresponding dosing feeder are arranged on the material inlet of the rotating gas generator.

Beneficial effects of this invention include:

I. Short heating time and high oxygen utilization rate with complete reaction.

II. The reaction space is small and the high-temperature area is concentrated, which keeps the lining of the reaction furnace far away from the radiation and there exists a circular protective zone between the high-temperature zone and the lining.

III. Particles are easily collided with each other, which is beneficial to settlement after reaction with less smoke.

IV. The productivity is good enough to adjust the needs for high-oxygen-concentration strengthening smelting with low energy consumption and less investment.

V. The structure is simple and the control and operation mode is convenient and reliable. The potential energy of the reaction gas can be made full use of, and the operation cost is low.

Where:

1: outer shell, 2: rotating gas generator, 3: material channel, 4: flow distributing device, 5: dosing feeder, 6: control valve, 7: rotary air inlet, 8: central axis, 9: velocity controller, 10:

lifting device, 11: material flow, 12: reaction gas, 13: reaction furnace, 14: protective layer, 15: gas-solid mixed rotating fluid, 16: backflow protection area, 17: axis, 18: blocking board.

DETAILED DESCRIPTION OF THE EMBODIMENTS

Below is a further description of the attached figures and particular implementations.

Figure 1:
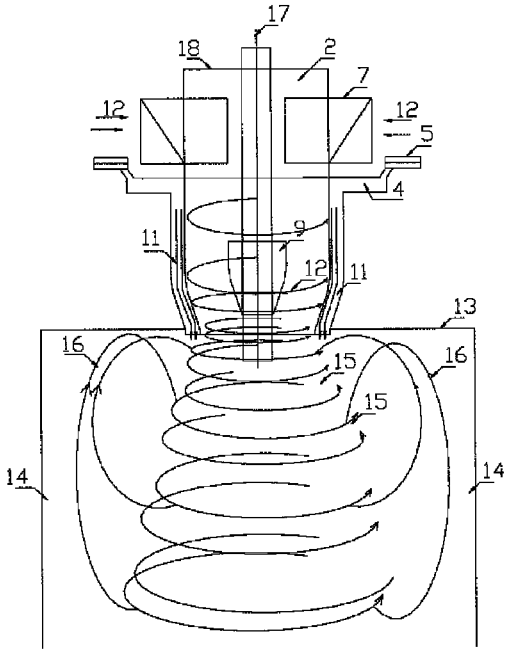
FIG. 1 is a schematic diagram of a floating entrainment metallurgical reactor.
Figure 2:
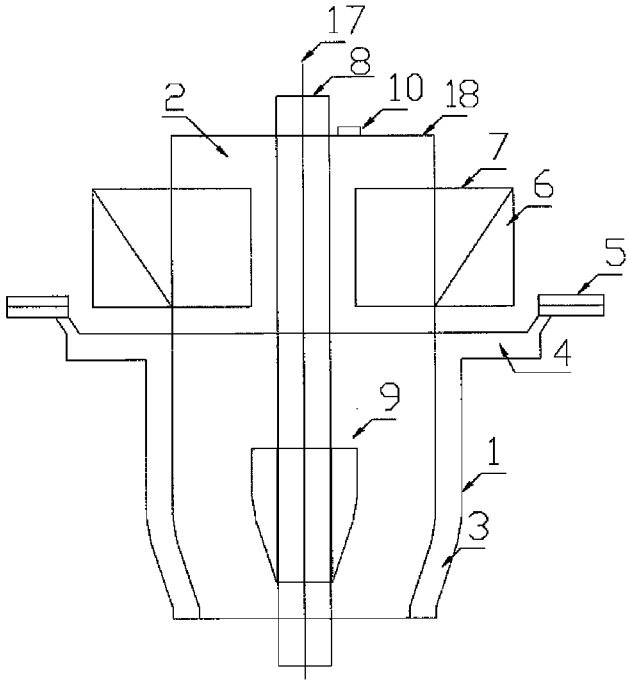
FIG. 2 is a schematic diagram of the rotating gas generator.
Figure 3:
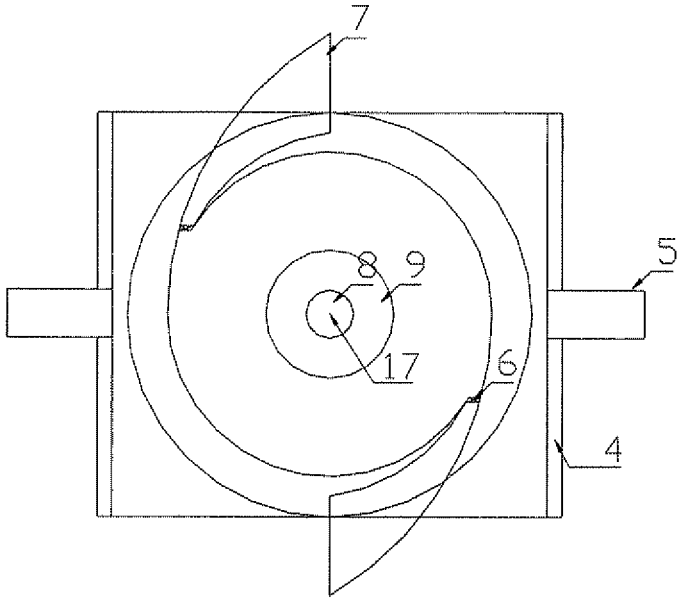
FIG. 3 is a top view of FIG. 2.

FIGS. 1-3 illustrate a floating entrainment metallurgical reactor used in a process, which include gas supply, material supply, and an airflow reaction;

Gas supply: the reaction gas 12 is tangentially fed into the rotating gas generator 2 along a plurality of uniformly distributed rotary air inlets 7 and adjusted by the control valve 6 to form controllable rotating airflow, in addition, a conical exit air speed controller 9 that can be moved up and down is provided to control the exit area of the rotating gas generator, thus controlling the velocity of the reaction gas into the reaction furnace 13;

Material supply: the powdery material flow 11 fall freely through the circular space, enters the reaction furnace 13 and then becomes involved in the high-speed rotating airflow;

Airflow reaction: the furnace gas, spurred and entrained by rotating fluid which is jetted into the reaction furnace from the top to the bottom, forms a gas-solid mixed rotating fluid 15 together with material and reaction gas, the gas-solid mixed rotating fluid comprising the powdery material highly dispersed in the reaction gas, which rotates at high speed in a radial direction moving downward in the axial direction.

Meanwhile, the furnace gas flows back from the bottom to the top of the reaction furnace, and the injection and rotation of the rotating fluid within the reactor furnace forms the furnace gas into relatively low-temperature circular backflow protection area 16, such that the molten droplets accompanied by the backflow furnace gas form into a refractory substance protection layer 14 on the lining of the reaction furnace.

The reaction gas 12 is oxygen-enriched air, whose oxygen concentration is 21% to 99% in volume ratio.

The gas-solid two-phase mixed rotating fluid 15 rotates at a high speed around the central axis 17 of the reaction furnace 13, and the material particles are heated to the ignition point by the backflow furnace gas and the radiant heat in the furnace.

A floating entrainment metallurgical reactor is equipped with a rotating gas generator 2 in the center top of which is blocked by a blocking board 18, and is divided into three parts: a plurality of evenly distributed rotary air inlets 7 are set on the upper section of the rotating gas generator vertical to the central axis 17, and the middle part is a cylinder. In order to get a greater centripetal acceleration after the reaction air is jetted out, the exit is in the shape of a cone with gradual shrinkage. In order to prove a certain initial velocity when fed into the rotating gas generator, a control valve 6 is installed at the rotary air inlet. The central axis 8 of the rotating gas generator is provided with a center axle sleeved with a conical outlet velocity controller 9 which can allow up-and-down movement in the cavity of the rotating gas generator. The controller 9 is under control of the lifting device set on the blocking board 18 at the top of the rotating gas generator. The cavity refers to the reaction gas channel 10, and a reactor outer shell 1 is equipped on the outside, and the outer shell 1 shares the same central axis 17 with the rotating gas generator 2. There is a circular space between the outer shell 1 and the generator 2 as a channel for materials 3. Flow distributing devices 4 are set on the material inlet of the outer shell 1 with each flow distributing device 4 being connected to a corresponding dosing feeder 5.

The exit at the lower end of the rotating gas generator is in the shape of a cone.

The upper end of the center axle is fixed on the blocking board 18 at the top of the rotating gas generator 2.

The outer shell 1 is equipped with water-cooling elements.

The technical scheme of this invention is not limited to the particular implementations described in this invention. All technologies with no detailed description in this invention are prior arts.

The invention claimed is:

1. A floating entrainment metallurgical process, comprising:

tangentially feeding reaction gas into a rotating gas generator along a plurality of uniformly distributed rotary air inlets and adjusting a control valve to form controllable rotating airflow within the rotating gas generator;

controlling a velocity of the reaction gas that exits the rotating gas generator into a reaction furnace with a conical exit air speed controller that can be moved up and down to control an exit area of the rotating gas generator;

channeling powdery material flow through a circular space formed between a reactor outer shell and the rotating gas generator into the reaction furnace; and forming in the reaction furnace a gas-solid mixed rotating fluid comprising the powdery material highly dispersed in the reaction gas that is jetted from the rotating gas generator into an upper portion of the reaction furnace, and rotating the gas-solid mixed rotating fluid at high speed in a radial direction, moving in an axial direction from an upper portion to a lower portion of the reaction furnace;

wherein furnace gas, which is spurred and entrained by the rotating gas that is jetted into the reaction furnace, flows from an upper portion to a lower portion of the reaction furnace, the furnace gas in the lower portion of the reaction furnace flows back towards the upper portion of the reaction furnace, the injection and rotation of the rotating gas within the reactor furnace forming a relatively low-temperature circular backflow protection area, such that molten droplets accompanied by the backflow furnace gas form into a refractory substance protection layer on a lining of the reaction furnace.

2. The floating entrainment metallurgical process as described in claim 1, wherein the reaction gas is oxygen-enriched air with an oxygen concentration from 21% to 99% in volume.

3. The floating entrainment metallurgical process as described in claim 1, wherein the gas-solid mixed rotating fluid rotates at a high speed around a central axis of the reaction furnace, and the material particles are quickly heated to an ignition point by the backflow furnace gas and radiant heat in the furnace.

4. A floating entrainment metallurgical reactor, comprising:

a rotating gas generator centrally located relative to a vertical central axis of the reactor, a top of the rotating gas generator being blocked by a blocking board;

a plurality of evenly distributed rotary air inlets set on an upper section of the rotating gas generator vertical to the central axis, the rotary air inlets each comprising a control valve configured to adjust an initial velocity of reaction gas when fed into the rotating gas generator;

the central axis of the rotating gas generator is set with a vertical center axle sleeved with a conical outlet wind velocity controller, the conical outlet wind velocity controller being slidably moveable up and down along the vertical axle within a cavity of the rotating gas generator the cavity being a reaction gas channel;

a reactor outer shell equipped on an outside portion of the reactor, the outer shell sharing the same central axis with the gas generator;

a circular space between the outer shell and the rotating gas generator defining a channel for materials; and a plurality of flow distributing devices set on a material inlet of the rotating gas generator, each flow distributing device being connected to a corresponding dosing feeder.

5. The floating entrainment metallurgical reactor as described in claim 4, wherein an exit at a lower end of the rotating gas generator is in a shape of a cone.

6. The floating entrainment metallurgical reactor as described in claim 4, wherein an upper end of the center axle is fixed on the blocking board at the top of the rotating gas generator.

7. The floating entrainment metallurgical reactor as described in claim 4, wherein the outer shell is equipped with water-cooling elements.

8. The floating entrainment metallurgical reactor as described in claim 4, wherein a lifting device for the conical outlet wind velocity controller is set on the blocking board to control wind velocity.

* * * * *